United States Patent [19]

Bajulaz

[11] 4,170,310

[45] Oct. 9, 1979

[54] INSTALLATION FOR MECHANICAL STORAGE, PARTICULARLY FOR THE PARKING OF AUTOMOTIVE VEHICLES

[75] Inventor: Roger Bajulaz, Chambesy, Switzerland

[73] Assignee: Rotopark S.A., Geneva, Switzerland

[21] Appl. No.: 860,189

[22] Filed: Dec. 13, 1977

[30] Foreign Application Priority Data

Dec. 24, 1976 [CH] Switzerland ..... 16301/76

[51] Int. Cl.[2] ..... E04H 6/22

[52] U.S. Cl. ..... 414/241; 414/700

[58] Field of Search ..... 214/16.1 CB, 16.1 CC, 214/16.1 CE, 701 R, 701 P, 701, 750, 16.4, 16.4 A, 16.4 B

[56] References Cited

U.S. PATENT DOCUMENTS

| | | | |
|---|---|---|---|
| Re. 27,283 | 2/1972 | Bajulaz | 214/16.1 CB X |
| 2,745,561 | 5/1956 | Natkanski | 214/16.1 CE |
| 3,339,709 | 9/1967 | Bajulaz | 214/16.1 CB X |

*Primary Examiner*—Robert G. Sheridan

*Attorney, Agent, or Firm*—Young & Thompson

[57] ABSTRACT

The invention relates to a mechanical storage installation in which the vertical axis of the elevator shaft orthogonally intersects the axis of the horizontal rolling tracks receiving the series of storage carriages. In this storage the elevator comprises at least a guide structure located outside the horizontal rolling tracks and a mobile device driven reciprocably along this vertical structure, this mobile device carries at least a retractable comb located in its active position inside the rolling tracks and in its inactive position outside of them, and the comb is connected to the mobile device by a single connection, which, during active vertical movements of the comb, traverses the horizontal rolling tracks by passages provided in these latter.

13 Claims, 8 Drawing Figures

INSTALLATION FOR MECHANICAL STORAGE, PARTICULARLY FOR THE PARKING OF AUTOMOTIVE VEHICLES

There exist various types of installations for mechanical storage, particularly for automotive vehicles, which make use of elevators, and the present invention concerns such an installation of the type in which the axis of the elevator orthogonally intercepts the axis of the rolling tracks on which, at the various levels, these series of carriages are provided to receive the vehicles, containers or other articles to be stored. An installation of this type is described for example in Swiss Pat. No. 370,564.

Until the present, in such installations for mechanical storage, the elevators utilized are of the "pater noster"-type, that is to say, continuously moving. This is important in fact because the elevator platforms must circulate about the horizontal rolling track rails of the storage carriages. These elevators are relatively complicated and require special technology and are relatively large by virtue of the fact that during their circulation the platforms rise above the floor to the upper level of the storage installation.

The present invention has as its main object the provision of an elevator for such a storage installation which will be simpler, will use well-established known technology and will reduce the size. Moreover, the new installation should permit more rapid storage or retrieval of an article.

The present invention has for an object the provision of a mechanical storage installation in which the axis of the vertical elevator shaft orthogonally intercepts the axis of the horizontal rolling tracks receiving the series of storage carriages, characterized by the fact that this elevator comprises at least one vertical guide structure situated outside the horizontal rolling tracks and a mobile device driven reciprocably along the length of this vertical structure, by the fact that this mobile device carries at least one retractable comb located in an active position inside the rolling tracks and in an inactive position outside them, by the fact that the comb is connected to the mobile device by a novel connection which, during active vertical movements of the comb, traverses the horizontal rolling tracks through passageways provided in the latter.

The annexed drawing shows schematically and by way of example one form of execution of the installation according to the invention.

Figure 1:
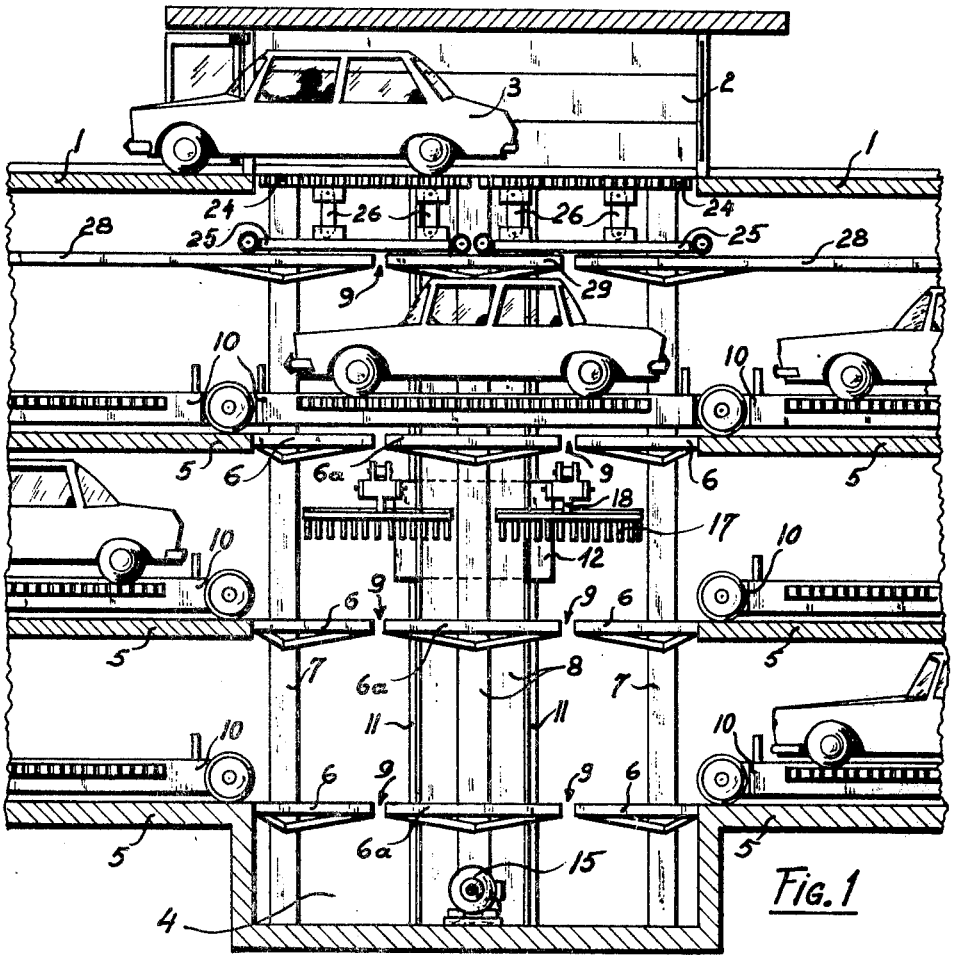
FIG. 1 is a section on the longitudinal axis of the elevator shaft.
Figure 2:
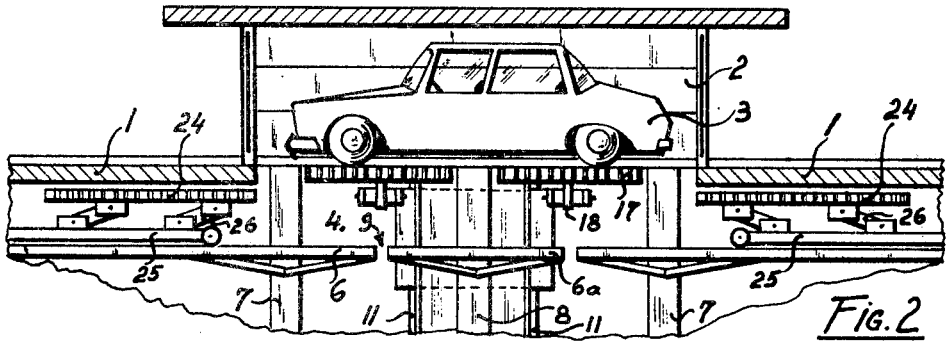
FIG. 2 is a partial cross section like that of FIG. 1, the covering closure being in retracted position.
Figure 3:
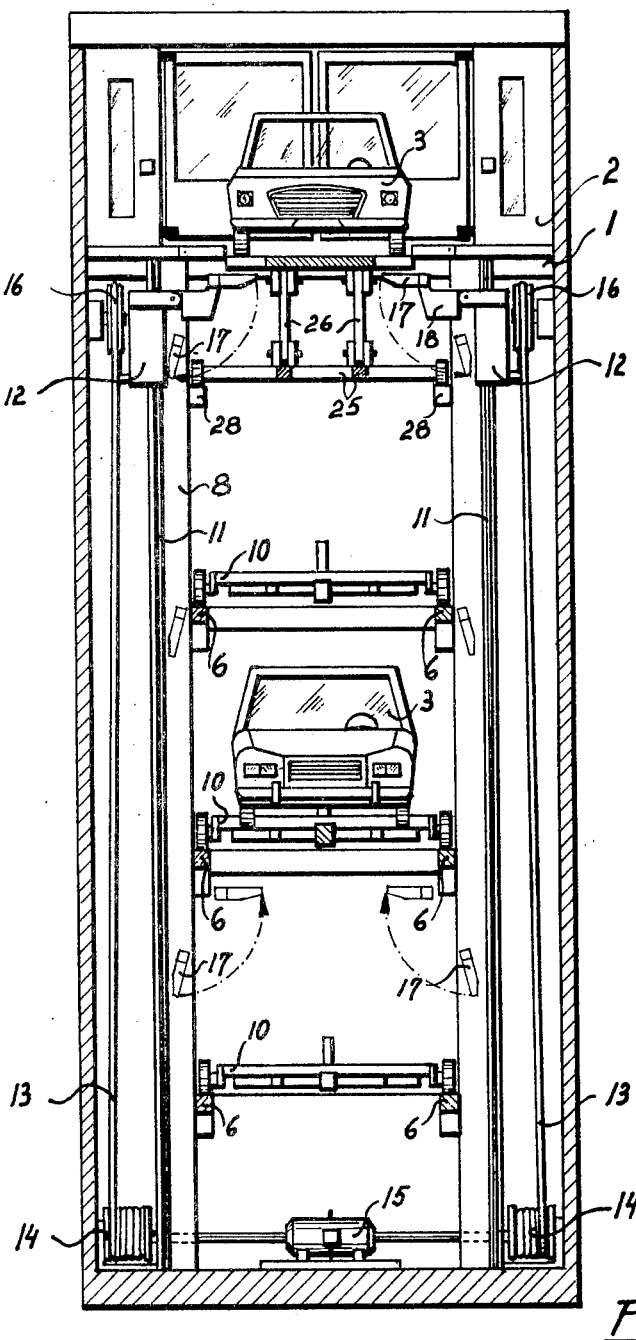
FIG. 3 is a cross section on the traverse axis of the elevator shaft.
Figure 4:
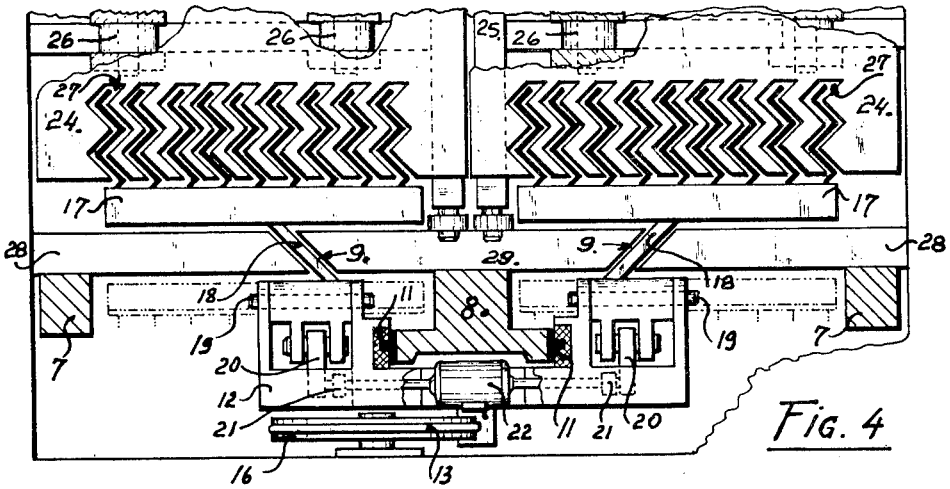
FIG. 4 is a top plan view, the closure cover being closed.

The installation for mechanical storage of vehicles, containers or other articles comprises several superposed storage levels each comprising a rolling track along the length of which travels a series of carriages. These rolling tracks may be continuous as in Swiss Pat. Nos. 370,564 or 399,309, or discontinuous. In the case in which the rolling tracks are continuous, the series of carriages comprise at least one empty space whose length corresponds approximately to that of one carriage. The installation also comprises, for each series of carriages, drive means permitting the series of carriages to be caused to circulate in both directions along the rolling tracks. This drive means may be of known type and will not be here described in detail.

Each carriage comprises a support formed by an assembly of teeth destined to receive one load. The positioning or removal of a load onto or from a carriage is effected by the passage of the teeth of the comb of the elevator between the support teeth of a carriage.

This method of loading or unloading of a charge being well known, it will not here be described in detail.

This installation comprises also a shaft designed to receive an elevator, whose vertical axis orthogonally intersects the axis of the superposed horizontal rolling tracks.

In the embodiment shown in the drawing, the installation is intended for the storage of automotive vehicles and comprises at ground level 1 a chamber 2 in which the user will leave or receive his car 3. This chamber 2 is constructed above the elevator shaft 4. This installation also comprises underground storage levels each comprising a rolling track. These rolling tracks are constituted by a concrete slab 5 and, where they traverse the elevator shaft, by beams 6 in prolongation of the slab, secured to a fixed vertical structure 7. Beams **6*a* disposed in prolongation of beams 6, complete the rolling tracks. These beams 6*a* are carried by a vertical fixed structure 8 located, like structures 7, outwardly of the rolling tracks. The passageways or gaps 9 provided between beams 6 and 6*a* do not impede the rolling of the carriages 10** which are disposed on the rolling tracks.

The fixed vertical structures 7 and 8 extend full height of the elevator shaft and are spaced a distance greater than the length of an elevator tooth. Moreover, they are so located as never to be disposed in the path of an elevator tooth.

The elevator of this installation comprises, in the exemplified embodiment, two mobile devices 12 guided along vertical rails 11 fixed to the vertical structures 8 facing into the shaft 4. These mobile devices 12 are driven with vertical reciprocatory movement along rails 11 by cables 13 wound on winches 14 both of which are driven by the same electric motor 15. These winches and this electric motor are disposed at the bottom of shaft 4. There is thus a conventional drive system which is found in the greater number of known elevators, lifts and hoists. These cables 13 pass over fixed-axis pulleys 16 located at the top of shaft 4 and their free end is fixed to the mobile devices 12, an electrical or electronic control may be provided to control the movements of the mobile devices as required. These mobile devices are located at the exterior of the rolling tracks in such a way that the space between the beams 6, **6*a* to one side of the shaft and the opposite beams 6, 6*a* is entirely free for movement of the carriages 10**.

Each mobile device 12 carries at least one manipulable comb 17.

In the illustrated example, each mobile device 12 carries two combs 17. Each comb 17 is connected to the mobile device by a single connection comprised in this case by a single arm 18 whose dimensions are such that it may pass through passages 9 located between beams 6, 6a when the comb is in its active position, inside the rolling tracks, during vertical movement of the mobile device.

Each arm 18 is pivoted at 19 on a mobile device 12 and is connected by a lever 20 to a shaft 21 fixed to the axle of an electric motor 22 mounted on the mobile device. This connection is such that when the comb 17 is in its horizontal active position, the lever 20 forms an angle with shaft 21, the latter resting against an abutment 23 preventing any downward swinging of comb 17. It is evident that the same motor 22 may drive the two combs 17 for movement relative to mobile device 12, a second connection 20, 21 being provided for the arm 18 of the second comb 17.

The important feature of this elevator resides in the fact that each comb 17 is connected to the mobile device by only a single arm or mechanical connection. As will be seen below, this feature makes possible the passage of each comb from its active position to its inactive retracted position, or vice versa, between each storage level.

In the inactive retracted position, the combs 17 are folded against the mobile device 12 (lower position in FIG. 6) and move, during vertical movements of mobile device 12, between the wall of the shaft 4 and the fixed structures 7 and 8. In this position, the space between the beams 6, 6a of the rolling tracks is totally free.

By contrast, in the active position (upper position in FIG. 6), the combs 17 extend horizontally between the beams 6, 6a of the rolling tracks and can receive a load. During the vertical movements of the mobile device 12, these combs 17 move between the beams 6, 6a of the rolling tracks and their single arm 18 passes at each level through one of the passages 9 provided between the beams 6 and 6a of the rolling tracks.

The passage of a comb 17 from its active position to its inactive retracted position, or vice versa, may take place between each level, while in these intermediate positions none of the elements of the vertical structures or the rolling tracks prevents this.

The movement of a comb 17 from its active to its inactive retracted position (top of FIG. 6), is effected by motor 22, shaft 21 and lever 20. Motor 22 is operated in such a way as to pivot shaft 21 clockwise. This effects first a slight lifting of comb 17 because lever 20 is not aligned with shaft 21. Then, the comb is folded down about its pivot 19 to the position shown in broken line in which it is completely folded against the mobile device 12.

This connection provides total security even in the case of untimely or incorrect actuation of motor 22. In fact, the power of motor 22 is deliberately chosen to be sufficiently low that if a load is located on comb 17, motor 22 cannot start either in one direction, because lever 20 is applied against abutment 23, or in the other direction, the weight of the load preventing the raising of comb 17 which takes place at the beginning of the folding movement.

Between ground level 1 and the first storage level are located closure covers 24, carried by carriages 25 through articulated arms 26. These closure covers have a surface whose configuration and dimensions are appropriate to permit closing the floor of the compartment, even when the elevator combs are in their service position at this level.

In fact, the teeth of these combs interfinger when they are in their highest possible position, in the openings or cutouts 27 of the closure cover 24.

These closure covers may be manipulated because carriages 25 move on a rolling track 28, 29 similar to the rolling tracks of the storage levels, so as to provide also passages 9 for the vertical movements of the combs 17 in their active position.

When the carriages 25 are spaced from each other, these arms 26 are inclined and the closure covers 24 are lowered parallel to themselves a distance such that they no longer interfere with the combs 17 and the ground level 1. Then, by a subsequent movement of the carriages outside the shaft 4, these closure covers are displaced longitudinally in such a way as to be disposed beneath the ground level 1 and outside the shaft 4.

It will be noted that in this storage installation, the number of interruptions or passages 9 of each rolling track corresponds to the number of combs 17 comprising the elevator.

There will now be described in connection with FIGS. 5 and 6 a possible mode of operation, among many others, of the storage installation.

Figure 5:
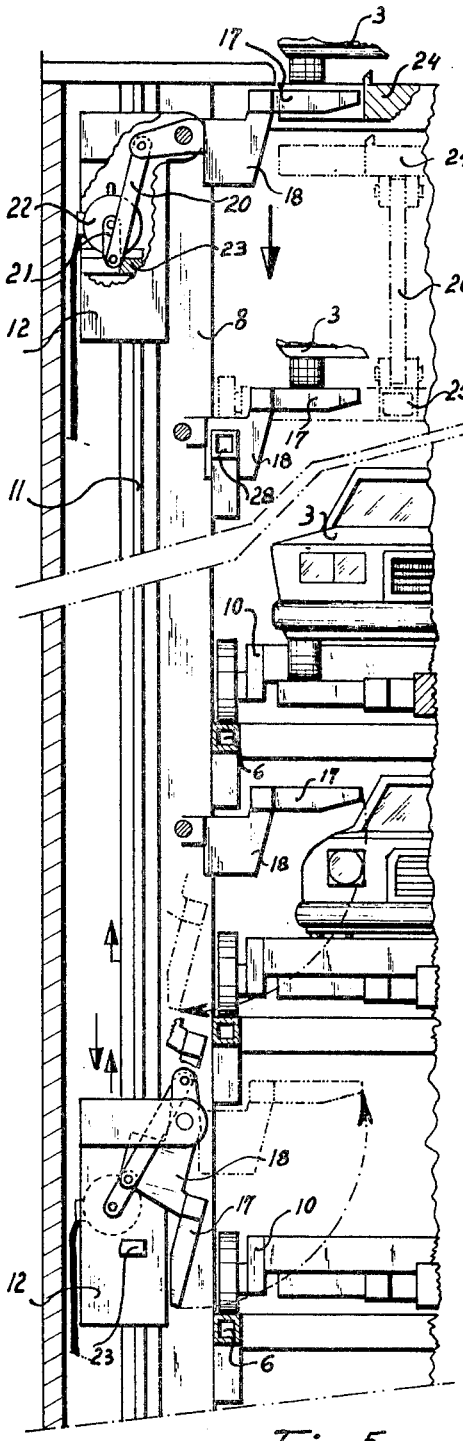
FIG. 5 is a partial cross section, on a larger scale, on the traverse axis of the elevator shaft, showing its combs in different positions occupied successively during storage of a vehicle.

At the very top of FIG. 5, will be seen a vehicle 3 resting on the closure covers 24 which are in active position closing the elevator shaft.

The mobile device 12 of the elevator is in its extreme upper position and its combs 17 are in active position and extend into the interior of shaft 4 between beams 6, 6a of the rolling tracks. In this position, the teeth of the combs 17 are disposed in cutouts 27 of the closure cover 24 and their upper surfaces are slightly below the rolling surface of the cover 24.

These closure covers 24 are then lowered and then moved apart and manipulated outside the shaft (cover in the position shown by broken lines). During this movement, the vehicle is transferred from the closure cover 24 to the combs 17 of the elevator. The mobile device 12 of the elevator is then moved downward the length of the fixed vertical structure 8 moving the vehicle carried by these combs 17 along a downward path. In the middle portion of FIG. 5 it will be seen that an empty carriage 10 has been preliminarily positioned in a centered position in the shaft 4 such that the elevator combs have passed in their descent through the teeth of this carriage and have thus deposited the vehicle 3 on this carriage.

The mobile device 12 is stopped just below the level onto which it has just deposited the vehicle, then the combs 17 of the latter are folded in active retracted position by motor 22.

It is evident that for this operation it is necessary that carriage 10 of the immediately subjacent level which will be centered in the shaft should be empty or that there be at this level no carriage 10 centered in the shaft 4.

Once the combs 17 are folded, the mobile device 12 moves vertically to below the level at which a vehicle must leave. This movement may take place during movement of the carriages 10 on the rolling tracks because the elevator no longer interferes with the latter. The mobile device 12 may again be raised to its upper position if a second vehicle must be stored before it is necessary to retrieve one.

Figure 6:
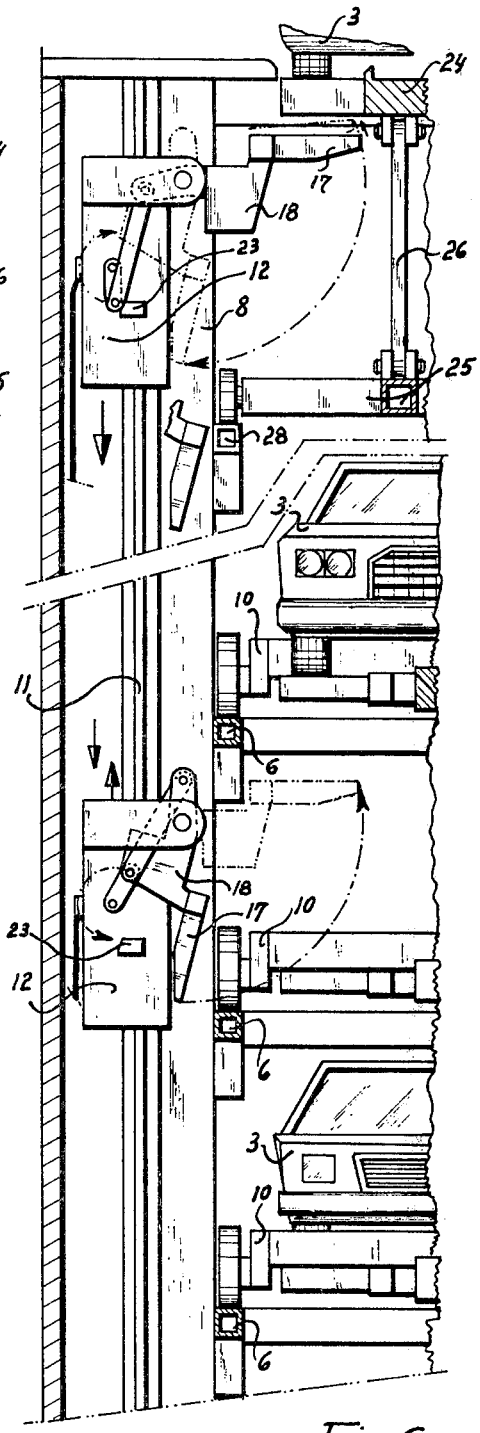
FIG. 6 is a view similar to that of FIG. 5 showing the elevator comb in the different positions that it occupies during exit of a vehicle.

FIG. 6 shows the necessary operations to remove a vehicle from the storage installation. A carriage 10 carrying the vehicle prior to its removal is centered in the shaft 4 and the mobile device 12 is disposed just below this level. The combs 17 are then placed in their active position by the motor 22 and the mobile device 12 is raised. Upon passage of the combs 17 through the teeth of the carriage 10, the vehicle is transferred to the elevator and is raised to the ground level of the chamber, the series of carriages at the upper levels being so disposed as to leave the elevator shaft free and the closure covers 24 being manipulated.

Then the closure covers 24 are brought together and placed in active position, such that the vehicle is transferred from the combs 17 onto the cover 24. The mobile device 12 then descends a distance sufficient to disengage combs 17 from the closure cover 24. The combs 17 may then again be folded to an active position.

As compared to known storage installations, the present installation has numerous advantages:

1. The construction of the elevator is simple and makes use of well-known existing hoist technology.

2. At no time in its operation does any portion of the elevator rise above the level of the rolling surface of the closure covers when they are in closed position. Thus the elevator does not interfere with any portion of the upper chamber.

3. The combs of the mobile device may be folded and unfolded between each storage level, the travel of the elevator is thus minimized. It is a matter of engaging or positioning a vehicle on a carriage. This results in a substantial saving of time. Once the closure covers are in closed position the elevator can be driven as well as the series of carriages of the storage levels so as to retrieve the next vehicle or to store a vehicle.

In this way also time is saved relative to existing installations. Moreover, the proportion between the time for taking charge of a vehicle, that is, during which someone may remain in the upper chamber, relative to the total cycle time, is increased. Thus, for a cycle of total predetermined duration, the present elevator by its nature leaves more time for the owner to take charge of his vehicle.

5. As soon as the closure covers are in operative position, the elevator may be operated and this simultaneously with the movements of the series of carriages, the combs being in inactive position and not interferring with the carriages.

Figure 7:
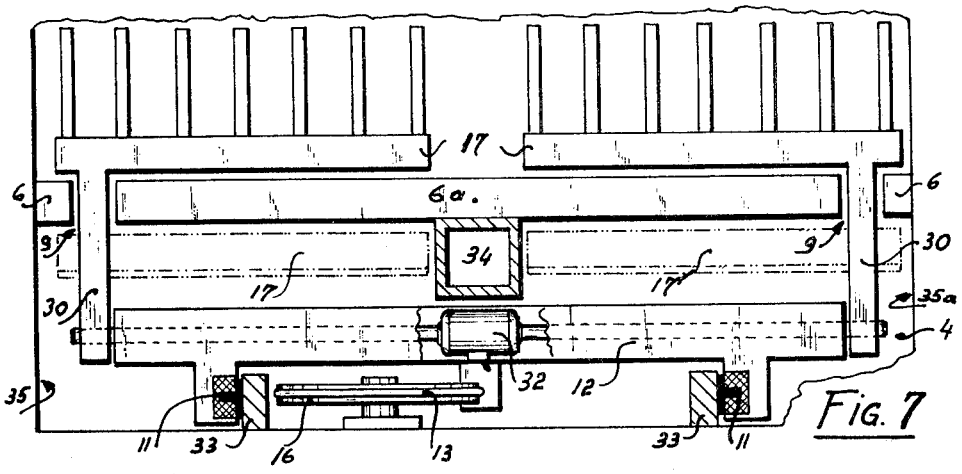
FIGS. 7 and 8 are partial schematic plan views, of two variants of the mechanical storage installation.

In a modification shown in FIG. 7, each mobile device 12 carries two combs 17 foldable by means of an arm 30 driven by an axle 31 of a motor 32.

This mobile device is guided by rails 33 fixed to the wall of the shaft 4 and which constitute the vertical guide structure.

The combs 17 are carried in false door relationship by arms 30. The central portion **6*a* of rail 6, 6*a* constituting the rolling track, is carried by a vertical structure 34 fixed only at its base and its top. The distance separating this vertical structure 34 from the faces 35, 35*a* of the shaft 4, which carry the rails 6** of the rolling tracks, is greater than the length of a comb, which latter may be disposed between these elements in folded position (position illustrated in broken line).

Figure 8:
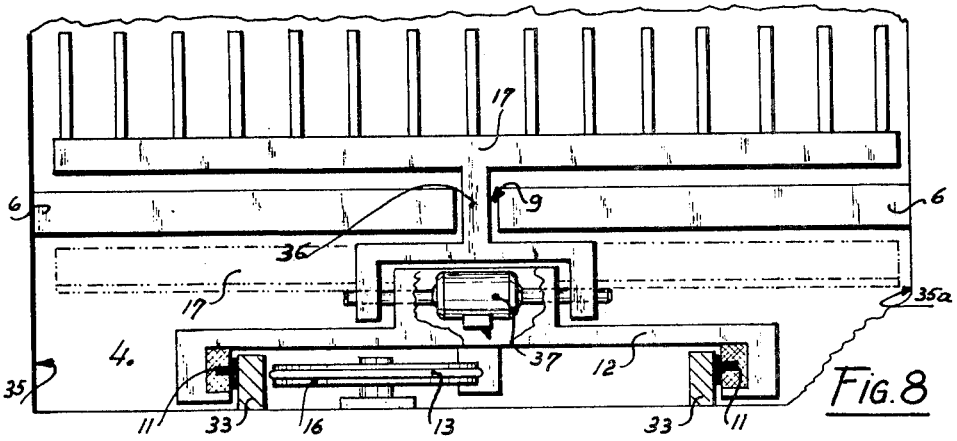

In the modification illustrated in FIG. 8 the mobile device 12, guided on rails 33, carries a single comb 17 connected by an arm 36 to the axle of motor 37 carried by the mobile device 12. The width of comb 17 is slightly less than that of shaft 14 whose lateral walls 35, **35*a* constitute the fixed vertical structure carrying the rolling tracks. In this embodiment the rolling track comprises rails 6 and has no central portions 6*a*** and therefore no vertical structure carrying this central portion.

I claim:

1. A mechanical storage installation comprising a vertical elevator shaft, a plurality of vertically spaced horizontal tracks intersecting said elevator shaft for storage of items to be stored in and retrieved from the installation, and an elevator disposed in the elevator shaft, the elevator comprising a vertical guide structure located outside the horizontal tracks and a mobile device movable along the guide structure, said movable device having at least one comb which is vertically swingable between an active position located inside the tracks and an inactive position outside of the tracks, and means for vertically swinging said comb between said positions between each adjacent vertically spaced pair of tracks, the tracks having openings therethrough for the vertical passage therethrough of said comb.

2. An installation as claimed in claim 1, said comb being connected to said mobile device by a single member which passes through a single said opening in each said track.

3. An installation as claimed in claim 2, each said mobile device carrying a plurality of said combs, each said track having a plurality of openings therethrough equal in number to and in registry with said single member of each said comb.

4. An installation as claimed in claim 1, said tracks being spaced apart a vertical distance greater than the length of the comb in a direction perpendicular to the tracks, to accommodate said vertical swinging movement of said comb between each pair of tracks.

5. An installation as claimed in claim 1, said elevator comprising two said vertical guide structures and two said mobile devices located on opposite sides of said shaft in mirror-image relation to each other.

6. An installation as claimed in claim 5, and a motor for driving the mobile devices of said two structures synchronously vertically.

7. An installation as claimed in claim 5, and means for moving said mobile devices with vertical rectilinear reciprocable movement only, said moving means comprising a pulley and a winch arranged at the top and bottom of the shaft with a cable reeved about said pulley and winch and connected with said mobile device, said mobile device being always positioned between said pulley and said winch.

8. An installation as claimed in claim 5, in which said means for vertically swinging said comb comprises a motor carried by said mobile device.

9. An installation as claimed in claim 8, and an arm fixed to the comb and mounted for pivotal movement on the mobile device, and a lever driven at one end by the motor and connected at its other end to said arm.

10. An installation as claimed in claim 9, said arm being pivoted to the mobile device at a point intermediate its connections to the lever and the comb.

11. An installation as claimed in claim 10, and an abutment carried by said mobile device which is contacted by said lever when the comb is in its raised position to prevent downward swinging of the comb.

12. An installation as claimed in claim 8, and a manipulable closure cover disposed between the two tracks at one of the vertical ends of the installation and movable horizontally into and out of the elevator shaft, said closure cover when in the elevator shaft being adapted to interfinger with said comb so that the comb may be raised to the same level as the cover or lowered beneath the cover.

13. An installation as claimed in claim 12, and a carriage that carries said closure cover for horizontal movement, and a horizontal rolling track between said two tracks.

* * * * *